United States Patent [19]

Gustafsson

[11] Patent Number: 4,840,318

[45] Date of Patent: Jun. 20, 1989

[54] WELDED CONICAL GRINDING CUTTER

[75] Inventor: Helmer Gustafsson, Valkeakoski, Finland

[73] Assignee: Yhtyneet Paperitehtaat Oy Jylhavaara, Valkeakoski, Finland

[21] Appl. No.: 689,474

[22] Filed: Jan. 7, 1985

[51] Int. Cl.[4] ..... B02C 19/00

[52] U.S. Cl. ..... 241/294; 241/261.1

[58] Field of Search ..... 241/261.1, 296, 261.2, 241/297, 261.3, 298, 300, 293, 294; 228/120, 184, 176

[56] References Cited

U.S. PATENT DOCUMENTS

| | | | |
|---|---|---|---|
| 35,036 | 4/1862 | Palmer | 241/261.1 X |
| 2,725,795 | 12/1955 | Stuck | 241/294 |
| 3,239,913 | 3/1966 | Richmond | 228/120 X |
| 3,576,697 | 4/1971 | Lorch | 228/120 X |
| 3,614,826 | 10/1971 | Pilao | 241/296 X |
| 4,019,080 | 4/1977 | Besson | 228/120 X |

FOREIGN PATENT DOCUMENTS 54351 7/1978 Finland .

*Primary Examiner*—Mark Rosenbaum
*Attorney, Agent, or Firm*—Browdy and Neimark

[57] ABSTRACT

A conical grinding cutter for use in grinding, or refining, wood pulp, wherein the cutter part constituted by the mantle of the cone is assembled of a plurality of separate sectors. In order to improve the grinding cutter of prior art composed of sectors, in the present invention the cutter sectors have been welded together by their sides for achieving a rigid juncture substantially over the entire length of the grinding cutter.

6 Claims, 1 Drawing Sheet

WELDED CONICAL GRINDING CUTTER

BACKGROUND OF THE INVENTION

The present invention concerns a conical grinding cutter for use in grinding, or refining, wood pulp, wherein the cutting part constituted by the mantle surface of a cone is assembled of a plurality of separate sectors. A grinder, or refiner, of this type comprises two cone-shaped cutters, the outer and the inner, of which one at least rotates, and their surface facing each other having been provided with an appropriate furrow pattern so that when the cutter is rotating the ridges following each other with a small interval will grind the wood to fine pulp.

In the prior art such conical grinding cutters are known which have been produced by casting in one place. The problem is then, however, that it is difficult to achieve good casting quality; therefore the reject percentage is high, the casting process expensive and the delivery time objectionably long. Causes of foundry technology alone impose major restrictions on the casting of objects of this size and shape, and it is not possible to produce a surface patterning meeting high enough quality standards. Morever, manufacturing of the pattern equipment needed in mold preparation is expensive and time-consuming. In practice, there are furthermore restrictions regarding choice of material.

It is also known to manufacture conical grinding cutters by welding the ridges fast to the mantle one by one. This procedure, too, is expensive and time-consuming, as anybody will realize. Morever, steel ridges of weldable material have no long service life.

Through the Finnish Pat. No. 54,351 is also known a conical grinding cutter assembled of separate steel sectors. By forming the conical grinding cutter of separate cutter sectors one gains the advantage that the casting process is facilitated and rather more fine-feathered cutter patterns can be cast. It is also a remarkable improvement that the casting quality improves and hereby the reject percentage goes down. In addition, the time consumed in preparing the pattern equpiment needed in mold making is short and the work is comparatively inexpensive. However, the drawback is present that the cutter sectors have been interconnected with flanges at their ends only, whereby the construction of the conical grinding cutter is not made rigid enough. We have observed that in the case of cutters requiring such high manufacturing accuracy, where the distance between the cutter surfaces facing each other is only a fractoin of one millimetre, the grinding efficiency is substantially impaired by the least yielding of an inadequately stiffened cutter sector.

OBJECT OF THE INVENTION

The object of the present invention is to achieve an improvement in respect of the drawbacks mentioned above.

The invention is mainly characterized in that the cutter sectors have been welded together by their sides in order to obtain a rigid juncture substantially over the entire length of the grinding cutter. In this way the construction of the grinding cutter is made rigid enough and good grinding efficiency is achieved.

An advantageous embodiment of the invention is characterized in that the cutter sectors of the grinding cutter have been joined with each other with a continuous weld. In this way the structure of the grinding cutter becomes tightly sealed, that is, the corrosive substance flowing within the cutter cannot through the interstices of the sectors come into contact with structures outside the grinding cutter and thereby inflict corrosion damage on them.

An advantageous embodiment of the invention is also characterized in that the cutter sectors of the grinding cutter have been joined together with an interrupted weld. In frequent instances a rigid enough structure of the grinding cutter is obtained with an interrupted weld, and it makes for faster assembly.

An advantageous embodiment of the invention is also characterized in that the cutter sectors have been made of weldable material.

An advantageous additional embodiment of the invention is characerized in that on the sides of the cutter sectors have been cast, or in another way produced, one or several junction pieces consisting of weldable material. The advantage is hereby gained that the cutter sectors may be cast of the material which is most appropriate for cutter material in each instance. It is furthermore characteristic that the junction pieces are provided with anchoring holes extending all the way through the piece. The junction pieces are by their action better anchored in the casting, and in this case the casting is not cooled at excessive rate by the junction pieces. It is furthermore characteristic that on the junction pieces casting lugs have been provided. The junction piece or pieces are held in their proper place during the casting process. These lugs are removed on completed casting.

BRIEF DESCRIPTION OF THE DRAWINGS

The invention is in the following described in detail with reference made to the attached drawings.

DETAILED DESCRIPTION OF PREFERRED EMBODIMENTS

Figure 1:
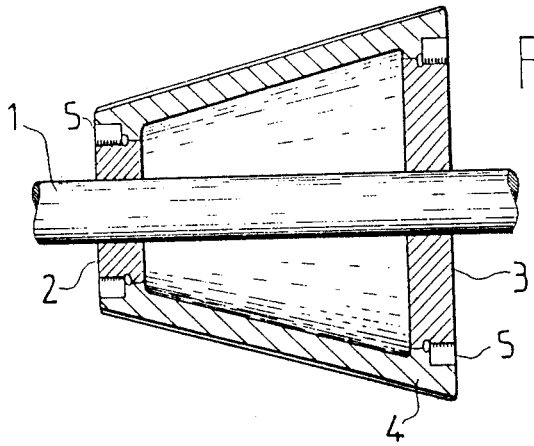
FIG. 1 presents a section of a rotating conical grinder inner cutter of the prior art, this cutter consisting of separate cutter sectors which have been interconnected at their ends.

In FIG. 1 is depicted a concial grinding cutter as known in the prior art, longitudinally sectioned. Weldable pieces 5 have been mounted on the ends of the cone. With the aid of these pieces, the cutter sectors 4 have been connected with the flanges 2, 3, which are rotated by the shaft 1.

Figure 2:
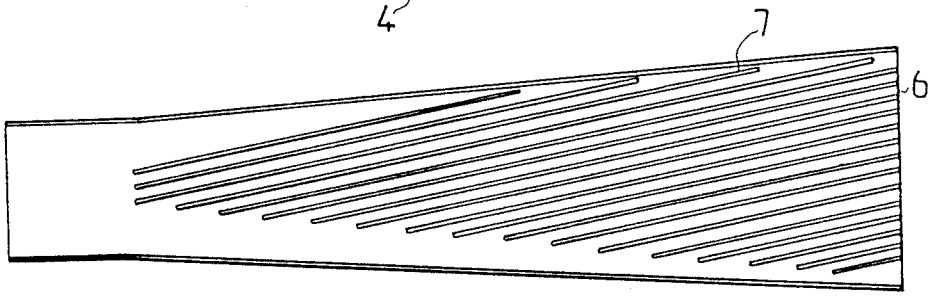
FIG. 2 presents the outer cutter sector of a static conical grinder's counter-cutter according to the invention, this sector having been cast of weldable material.

In FIG. 2 is depicted the outer cutter section 6 of a conical grinding cutter, made of weldable material. These cutter sectors 6 are mutually joined by welding them by their sides substantially over their entire length. The cutter sector 6 carries steel ridges 7.

Figure 3:
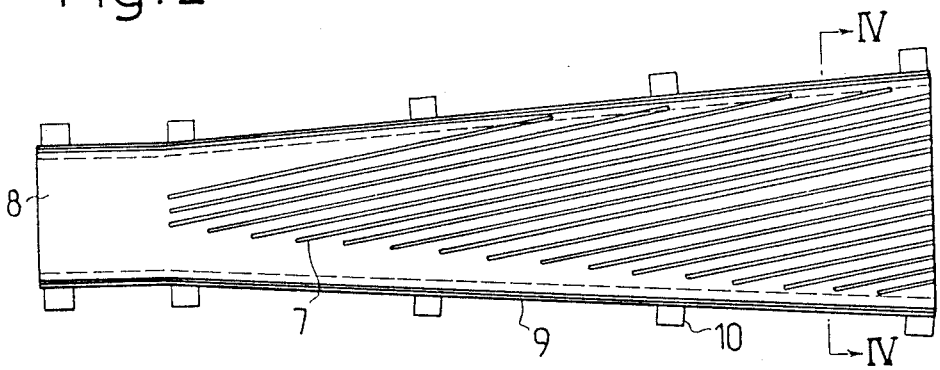
FIG. 3 presents the outer cutter sector of a static concial grinder's counter-cutter according to the invention to the sides of which have been cast junction pieces consisting of weldable material.
Figure 4:
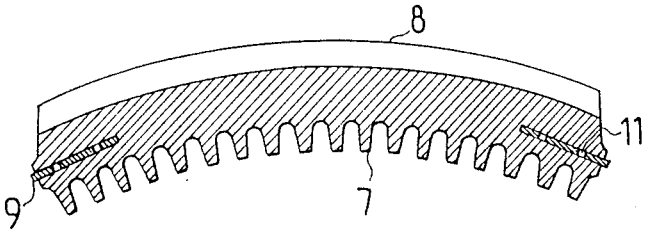
FIG. 4 presents the cross section of the outer cutter sector of the preceding figure.

Attached to the cutter sectors depicted in FIGS. 3 and 4 during, or nearly concurrently with, the casting process are junction pieces 9 consisting of weldable material. With the aid of these junction pieces 9, the cutter sectors 8 can be joined along their sides. The junction pieces 9 carry casting lugs 10, by the aid of which the junction pieces are properly positioned prior to casting. The casting lugs are removed on completed casting. The junction pieces have also been provided with piercing holes 11, through which the casting material flows, thereby producing better anchoring to the junction piece 9.

It is obvious to a person skilled in the art that the invention is not confined to the examples presented above and that it may rather vary within the scope of the claims following below.

I claim:

1. A conical grinding cutter for the grinding or refining of wood pulp, comprising a plurality of separately cast cutter sectors formed of a first material providing a long service life, each having been cast into a curved rigid configuration with a plurality of integrally cast ridges in the surface thereof, and each said sector having along its longitudinally extensive edges at least one junction piece formed of a second material which is weldable, each said sector being cast about and partially embedding said at least one junction piece, said cutter sectors being assembled adjacent one another along said longitudinally extensive edges to define a cone including a grinding portion constituted by a longitudinally extensive surface provided with said integrally cast ridges, said cutter sectors being welded together along said weldable junction pieces to obtain a stiff and rigid conical grinding cutter.

2. Grinding cutter according to claim 1, wherein said sectors are joined to each other with a continuous weld.

3. Grinding cutter according to claim 1, wherein said sectors are joined to each other with an interrupted weld.

4. Grinding cutter according to claim 1, wherein the junction pieces have piercing anchoring holes.

5. Grinding cutter according to claim 1, wherein on the junction pieces have been provided casting lugs.

6. A grinding cutter according to claim 1 wherein the junction pieces have piercing anchoring holes and casting lugs.

* * * * *